US008160477B2

(12) United States Patent
Anan et al.

(10) Patent No.: US 8,160,477 B2
(45) Date of Patent: Apr. 17, 2012

(54) PROCESS CARTRIDGE AND IMAGE FORMING APPARATUS

(75) Inventors: Osamu Anan, Susono (JP); Yasufumi Yoshino, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 681 days.

(21) Appl. No.: 12/335,087

(22) Filed: Dec. 15, 2008

(65) Prior Publication Data

US 2009/0297212 A1 Dec. 3, 2009

(30) Foreign Application Priority Data

May 27, 2008 (JP) ..... 2008-138039

(51) Int. Cl.
*G03G 21/16* (2006.01)

(52) U.S. Cl. ..... 399/111; 399/113

(58) Field of Classification Search ..... 399/110, 399/111, 113
See application file for complete search history.

(56) References Cited

U.S. PATENT DOCUMENTS

| | | | | |
|---|---|---|---|---|
| 5,465,136 | A | 11/1995 | Watanabe | 355/210 |
| 6,782,219 | B2 | 8/2004 | Yoshino et al. | 399/90 |
| 6,915,092 | B2 | 7/2005 | Yamaguchi et al. | 399/109 |
| 6,978,100 | B2 | 12/2005 | Yasui et al. | 399/103 |
| 6,983,115 | B2 | 1/2006 | Isobe et al. | 399/119 |
| 7,068,965 | B2 | 6/2006 | Yoshino et al. | 399/119 |
| 7,099,607 | B2 | 8/2006 | Suzuki et al. | 399/111 |
| 7,155,137 | B2 | 12/2006 | Yasui et al. | 399/103 |
| 7,366,439 | B2 | 4/2008 | Anan et al. | 399/109 |
| 2005/0069342 | A1 * | 3/2005 | Kanno et al. | 399/111 |
| 2007/0092291 | A1 | 4/2007 | Suzuki et al. | 399/111 |
| 2007/0206971 | A1 | 9/2007 | Yoshino | 399/111 |
| 2008/0138105 | A1 | 6/2008 | Kanno et al. | 399/111 |
| 2008/0138106 | A1 | 6/2008 | Kanno et al. | 399/111 |
| 2008/0138109 | A1 | 6/2008 | Anan et al. | 399/113 |
| 2008/0138110 | A1 | 6/2008 | Yoshino et al. | 399/114 |

FOREIGN PATENT DOCUMENTS

| | | |
|---|---|---|
| CN | 1601401 A | 3/2005 |
| JP | 5-188667 | 7/1993 |
| JP | 6-273987 | 9/1994 |
| JP | 2000-181328 | 6/2000 |
| JP | 2005-172906 | 6/2005 |
| JP | 2006-276190 | 10/2006 |

OTHER PUBLICATIONS

Office Action for corresponding Chinese Application No. 200810188523.8 dated Aug. 13, 2010.

* cited by examiner

*Primary Examiner* — David Gray
*Assistant Examiner* — Barnabas Fekete
(74) *Attorney, Agent, or Firm* — Fitzpatrick, Cella, Harper & Scinto

(57) ABSTRACT

A process cartridge and an image forming apparatus in which a charging roller is separated from a photosensitive drum by a predetermined distance and in which the separation between the charging roller and the photosensitive drum is released at the time of use without involving an increase in the burden on the user and erroneous releasing of the separation by user is prevented prior to use. The process cartridge, which is detachably mountable to the apparatus main body having an acting portion, includes a process cartridge frame, a locking portion locked with the frame to separate the charging roller from the photosensitive drum, a separation holding member having an acted portion which penetrates the frame and on which the acting portion can act, and a protruding portion provided on the frame and protruding beyond the acted portion at the position where the separation holding member is locked with the frame.

7 Claims, 16 Drawing Sheets

PROCESS CARTRIDGE AND IMAGE FORMING APPARATUS

BACKGROUND OF THE INVENTION

1. Field of the Invention

The present invention relates to an image forming apparatus such as an electrophotographic copying machine and an electrophotographic printer and a process cartridge detachably mountable to a main body of the image forming apparatus.

Here, an electrophotographic image forming apparatus forms an image on a recording sheet using an electrophotographic image forming method, and examples of the electrophotographic image forming apparatus include an electrophotographic copying machine, an electrophotographic printer (for example, a laser beam printer and an LED printer), a facsimile machine and a word processor.

Further, a process cartridge is a cartridge into which at least one of an electrophotographic photosensitive drum and charging means for charging the electrophotographic photosensitive drum are integrally incorporated, the cartridge being detachably mountable to a main body of an image forming apparatus.

2. Description of the Related Art

Conventionally, as an electrophotographic image forming apparatus, there is a color electrophotographic image forming apparatus of an in-line type in which multiple process cartridges are aligned. There is a contact development method of performing a development in the state in which a developing roller composing a process cartridge is in contact with a photosensitive drum. In this method, in order to keep a predetermined contact pressure between the developing roller and the photosensitive drum during an image formation, the developing roller is urged against the photosensitive drum.

In the case of this method, when the process cartridge is not used for a long time period in the state of being mounted on the main body of the image forming apparatus, there is a possibility that an elastic layer of the developing roller is permanently deformed. Whereby, an uneven image may be formed at the time of development.

Then, proposed is a process cartridge and an image forming apparatus in which there is provided a mechanism for separating a developing roller from a photosensitive drum in the case of performing no image forming operation (Japanese Patent Application Laid-Open No. 2005-172906).

On the other hand, the construction in which a charging roller is brought into contact with a photosensitive drum for charging the photosensitive drum is widely used. In such a contact charging, the charging roller needs to be disposed reliably in contact with the surface of the photosensitive drum, and hence the charging roller is in pressure contact with the surface of the photosensitive drum at a predetermined contact pressure. When the state of not being used for a long time period in this state continues, the elastic layer of the charging roller is permanently deformed, and thus an uneven density of an image of the rotation cycle of the charging roller occurs.

Thus, proposed is a method in which an insert member for separating the charging roller from the photosensitive drum is inserted into therebetween at the time of shipment of a process cartridge, and a user removes the insert member in use (Japanese Patent Application Laid-Open No. H05-188667).

Alternatively, proposed is a process cartridge having a mechanism in which a charging roller having been separated until then is brought into contact with a photosensitive drum when the process cartridge is mounted on the main body of the image forming apparatus (Japanese Patent Application Laid-Open No. H06-273987 and Japanese Patent Application Laid-Open No. 2000-181328).

SUMMARY OF THE INVENTION

The present invention is aimed to provide a process cartridge and an image forming apparatus, which being improvements of the above-described inventions.

That is, it is an object of the present invention to provide, a process cartridge and an image forming apparatus which can keep separating a charging roller from an image bearing member by a predetermined distance before use, and can release the separation state of the charging roller without the increase of the burden of a user in use.

Another object of the present invention is to provide a process cartridge and an image forming apparatus which enable prevention of erroneous releasing of the separating state of the charging roller by the user prior to use.

Further, another object of the present invention is to provide a process cartridge detachably mountable to an image forming apparatus including an acting portion, the process cartridge comprising:

a photosensitive drum;

a charging roller which is urged in a direction in which the charging roller is brought into contact with the photosensitive drum to charge the photosensitive drum;

a frame supporting the photosensitive drum and the charging roller; and a separation holding member which is movably provided on the frame and engaged with the charging roller, the separation holding member having a locking portion which is locked to the frame to separate the charging roller from the photosensitive drum, and an acted portion which is acted by the acting portion when the process cartridge is mounted to an apparatus main body of the image forming apparatus, for releasing a lock of the frame and the locking portion to bring the charging roller into contact with the photosensitive drum.

Still further, another object of the present invention is to provide an image forming apparatus for forming an image on a recording medium, the image forming apparatus comprising:

(i) an acting portion;

(ii) a process cartridge detachably mounted to an apparatus main body of the image forming apparatus, the process cartridge comprising:

a photosensitive drum;

a charging roller which is urged in a direction in which the charging roller is brought into contact with the photosensitive drum to charge the photosensitive drum;

a frame supporting the photosensitive drum and the charging roller; and a separation holding member which is movably provided on the frame and engaged with the charging roller, the separation holding member having a locking portion which is locked to the frame to separate the charging roller from the photosensitive drum, and an acted portion which is acted by the acting portion when the process cartridge is mounted to the apparatus main body of the image forming apparatus, for releasing a lock of the frame and the locking portion to bring the charging roller into contact with the photosensitive drum; and (iii) conveying means for conveying the recording medium.

Further features of the present invention become apparent from the following description of exemplary embodiments with reference to the accompanying drawings.

DESCRIPTION OF THE EMBODIMENTS (First Embodiment)

A process cartridge (hereinafter referred to as "cartridge") and a color electrophotographic image forming apparatus (hereinafter referred to as "image forming apparatus") according to a first embodiment of the present invention will be described with reference to the drawings.

(Entire Construction of Image Forming Apparatus) f

First, the entire construction of the image forming apparatus will be described with reference to FIG. 2. An image forming apparatus 100 illustrated in FIG. 2 has mounting portions 22 (22*a*, 22*b*, 22*c*, and 22*d*) (see FIG. 4) that are mounting means for four cartridges arranged side by side so as to be inclined with respect to the horizontal direction. Further, cartridges 7 (7*a*, 7*b*, 7*c*, and 7*d*) mounted to the mounting portions 22 respectively include electrophotographic photosensitive drums 1 (1*a*, 1*b*, 1*c*, and 1*d*).

Figure 2:
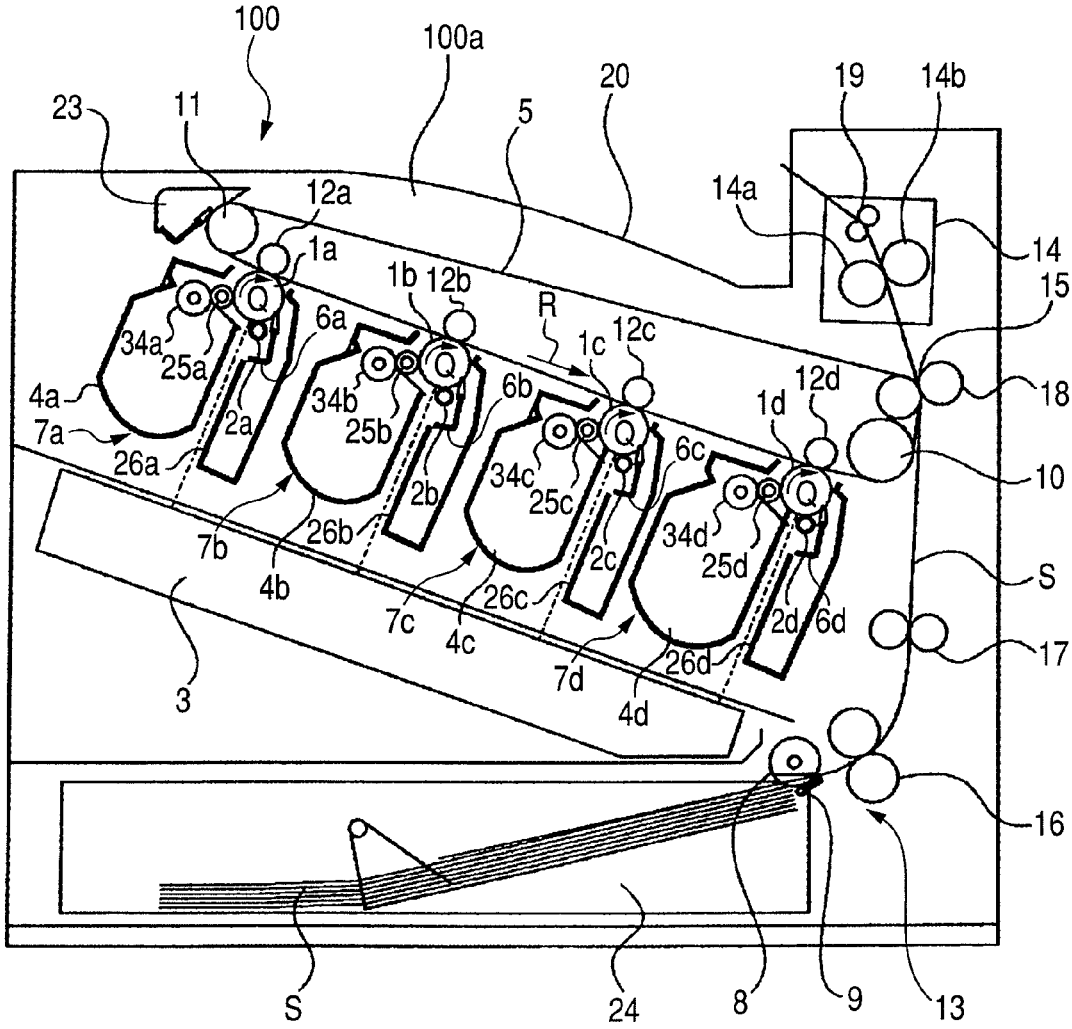
FIG. 2 is a diagram illustrating the entire construction of a color electrophotographic image forming apparatus.

The electrophotographic photosensitive drums (hereinafter referred to as the "photosensitive drums") 1 are rotated clockwise (in the direction indicated by the arrow Q) as seen in FIG. 2 by driving members (not shown). Around the photosensitive drums 1, there are successively arranged in the rotating direction the following process means acting on the photosensitive drums. That is, there are arranged cleaning members 6 (6*a*, 6*b*, 6*c*, and 6*d*) for removing developer remaining on the surfaces of the photosensitive drums 1 after transferring (hereinafter referred to as "toner"), charging rollers 2 (2*a*, 2*b*, 2*c*, and 2*d*) for uniformly charging the surfaces of the photosensitive drums 1, and developing units 4 (4*a*, 4*b*, 4*c*, and 4*d*) for developing electrostatic latent images on the surfaces of the photosensitive drums 1 by using toners. Further, there are arranged a scanner unit 3 that irradiates the photosensitive drums 1 with laser beams according to image information to form electrostatic latent images on the photosensitive drums 1, and an intermediate transfer belt 5 onto which four color toner images on the photosensitive drums 1 are collectively transferred. In this case, the photosensitive drums 1, the cleaning members 6, the charging rollers 2, and the developing units 4 are integrally incorporated into the cartridges 7. The cartridges 7 are detachably mountable to an apparatus main body 100*a* of the image forming apparatus 100 by a user.

The intermediate transfer belt 5 is passed over a driving roller 10 and a tension roller 11. Further, on the inner side of the intermediate transfer belt 5, primary transfer rollers 12 (12*a*, 12*b*, 12*c*, and 12*d*) are arranged so as to be opposed to the photosensitive drums 1 (1*a*, 1*b*, 1*c*, and 1*d*), respectively. Further, a transfer bias is applied to the primary transfer rollers 12 by a bias application means (not shown).

The photosensitive drums 1 rotate in the direction indicated by the arrow Q, the intermediate transfer belt 5 rotates in the direction indicated by the arrow R, and, further, a bias of positive polarity is applied to the primary transfer rollers 12, whereby the toner images formed on the photosensitive drums 1 are primarily transferred successively onto the intermediate transfer belt 5. Further, the four color toner images superimposed one upon the other on the intermediate transfer belt 5 are conveyed to a secondary transfer portion 15.

In synchronism with the above-mentioned image forming operation, a sheet S serving as a recording medium is conveyed by conveying means including a feeding device 13, a registration roller pair 17, etc. The feeding device 13 includes a feeding cassette 24 containing sheets S, a feeding roller 8 for feeding the sheets S, and a conveying roller pair 16 for conveying the fed sheets S. The feeding cassette 24 can be pulled out to the front side of the main body in FIG. 2. The sheets S contained in the feeding cassette 24 are held in pressure contact with the feeding roller 8, and separated one by one by a separation pad 9 (friction member separation system) to be conveyed.

Further, the sheet S conveyed from the feeding device 13 is conveyed to the secondary transfer portion 15 by a registration roller pair 17. At the secondary transfer portion 15, a bias of positive polarity is applied to the secondary transfer roller 18. As a result, the four color toner images on the intermediate transfer belt 5 are secondarily transferred onto the conveyed sheet S.

A fixing portion 14 as fixing means applies heat and pressure to the toner images formed on the sheet S to fix the images on the sheet. A fixing belt 14*a* is of a cylindrical configuration, and is guided by a belt guide member (not shown) to which heat generating means such as a heater is bonded. Further, the fixing belt 14*a* and a pressure roller 14*b* form a fixing nip under a predetermined pressure contact force.

Further, the sheet S which has been conveyed from the image forming portion and which has unfixed toner images thereon is heated and pressurized at the fixing nip between the fixing belt 14*a* and the pressure roller 14*b*. Then, the unfixed toner images on the sheet S are fixed to the sheet S. After this, the sheet S, to which the toner images have been fixed, is discharged onto a discharge tray 20 by a discharge roller pair 19.

On the other hand, the toners remaining on the surfaces of the photosensitive drums 1 after the toner image transfer is removed by the cleaning members 6. The toners thus removed are collected in removal toner chambers in the photosensitive member units 26 (26*a*, 26*b*, 26*c*, and 26*d*).

The toner remaining on the intermediate transfer belt 5 after the secondary transfer onto the sheet S is removed by a transfer belt cleaning device 23. The toner thus removed passes through a waste toner conveyance path (not shown), and is collected in a waste toner recovery container (not shown) arranged in an apparatus rear surface portion.

(Cartridge)

Figure 3:
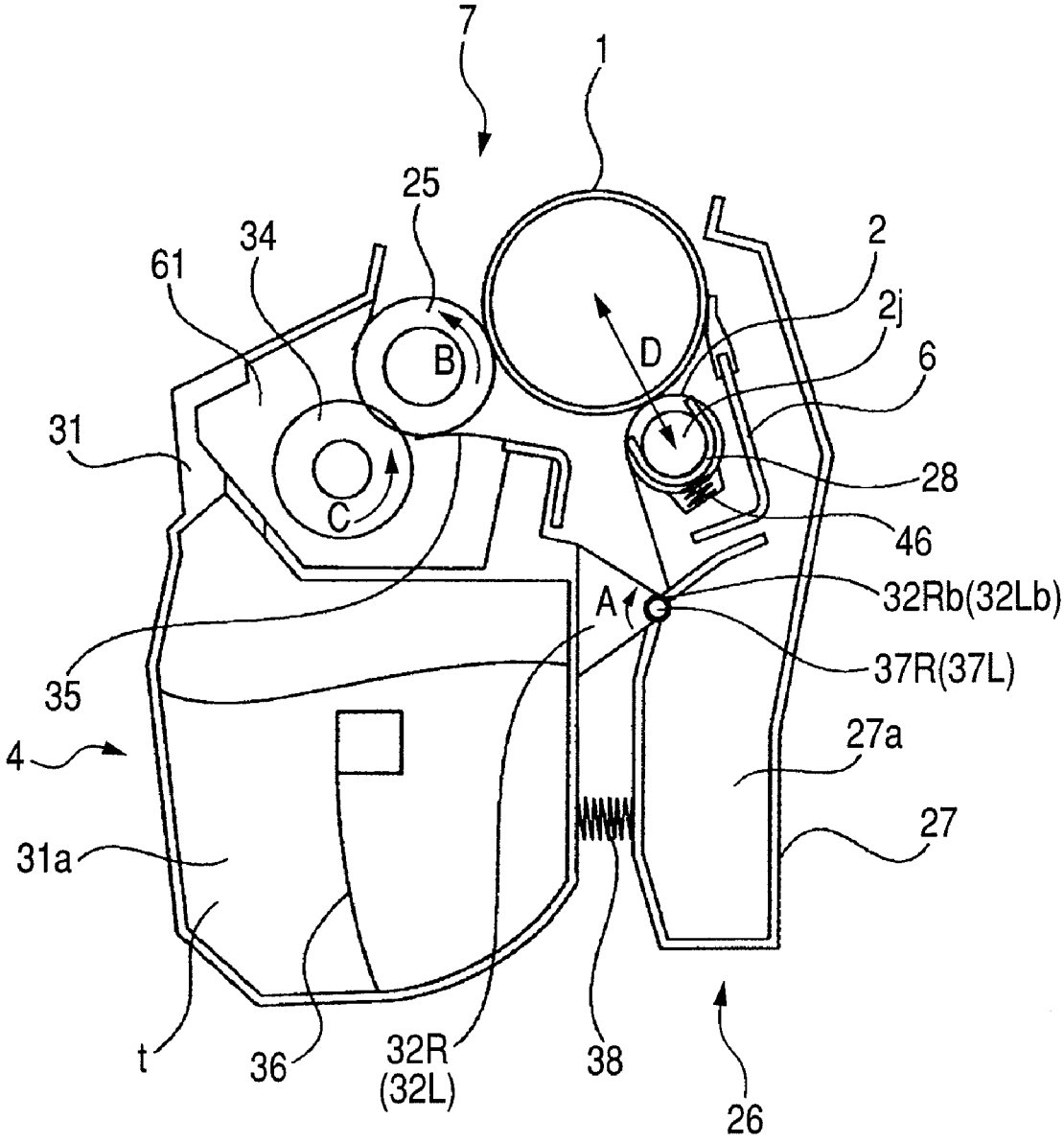
FIG. 3 is an explanatory sectional view of a cartridge.

Next, the cartridge of this embodiment will be described with reference to FIG. 3. FIG. 3 is a main sectional view of a cartridge 7 containing a toner "t". The cartridge 7*a* containing yellow toner "t", the cartridge 7*b* containing magenta toner "t", the cartridge 7*c* containing cyan toner "t", and the cartridge 7*d* containing black toner "t" are of the same construction.

The cartridge 7 is divided into two parts, that is, a photosensitive unit 26 including the photosensitive drum 1, the charging roller (charging means) 2, and the cleaning member (cleaning means) 6, and the developing unit 4 including a developing roller (developing means) 25.

With respect to a cleaning frame 27 of the photosensitive unit 26, the photosensitive drum 1 is rotatably mounted through bearings described below. Then, a drive force of a drive motor (not shown) is transmitted to the photosensitive unit 26, thereby rotationally driving the photosensitive drum 1 in accordance with an image forming operation. On the periphery of the photosensitive drum 1, there are provided the charging roller 2 and the cleaning member 6 as described above. Further, a residual toner removed from the surface of the photosensitive drum 1 by the cleaning member 6 is dropped into a removed toner chamber 27*a*. A charging roller bearing 28 is mounted to the cleaning frame 27 such that the charging roller bearing 28 can be moved in a direction indicated by an arrow D passing through the center of the charging roller 2 and the center of the photosensitive drum 1. A shaft 2*j* of the charging roller 2 is rotatably mounted to the charging roller bearing 28. Further, the charging roller bearing 28 is held in pressure contact with the photosensitive drum 1 by a charging roller pressing member 46.

The developing unit 4 includes the developing roller 25 which is in contact with the photosensitive drum 1 and which rotates in a direction indicated by an arrow B, and a developing frame 31. The developing roller 25 is rotatably supported by the developing frame 31 through bearing members 32 (32R and 32L) mounted at both longitudinal sides of the developing frame 31. Further, on the periphery of developing roller 25, there are provided a toner supply roller 34 which is in contact with the developing roller 25 and which rotates in a direction indicated by an arrow C, and a developing blade 35 for regulating a toner layer formed on the developing roller 25. In addition, in a toner containing portion 31*a* of the developing frame 31, there is provided a toner carrying member 36 for stirring the toner contained therein and for carrying the toner to the toner supply roller 34.

Further, the developing unit 4 is rotatably connected to the photosensitive unit 26 about shafts 37 (37R and 37L), which are fitted into holes 32Rb and 32Lb provided in the bearing members 32R and 32L, respectively. The developing unit 4 is urged by a compression spring 38, with the result that, at the time of image formation of the cartridge 7, the developing unit 4 rotates about the shafts 37 in a direction indicated by an arrow A, and the developing roller 25 abuts against the photosensitive drum 1.

(Mounting Construction of Process Cartridge to Image Forming Apparatus Main Body)

Figure 4:
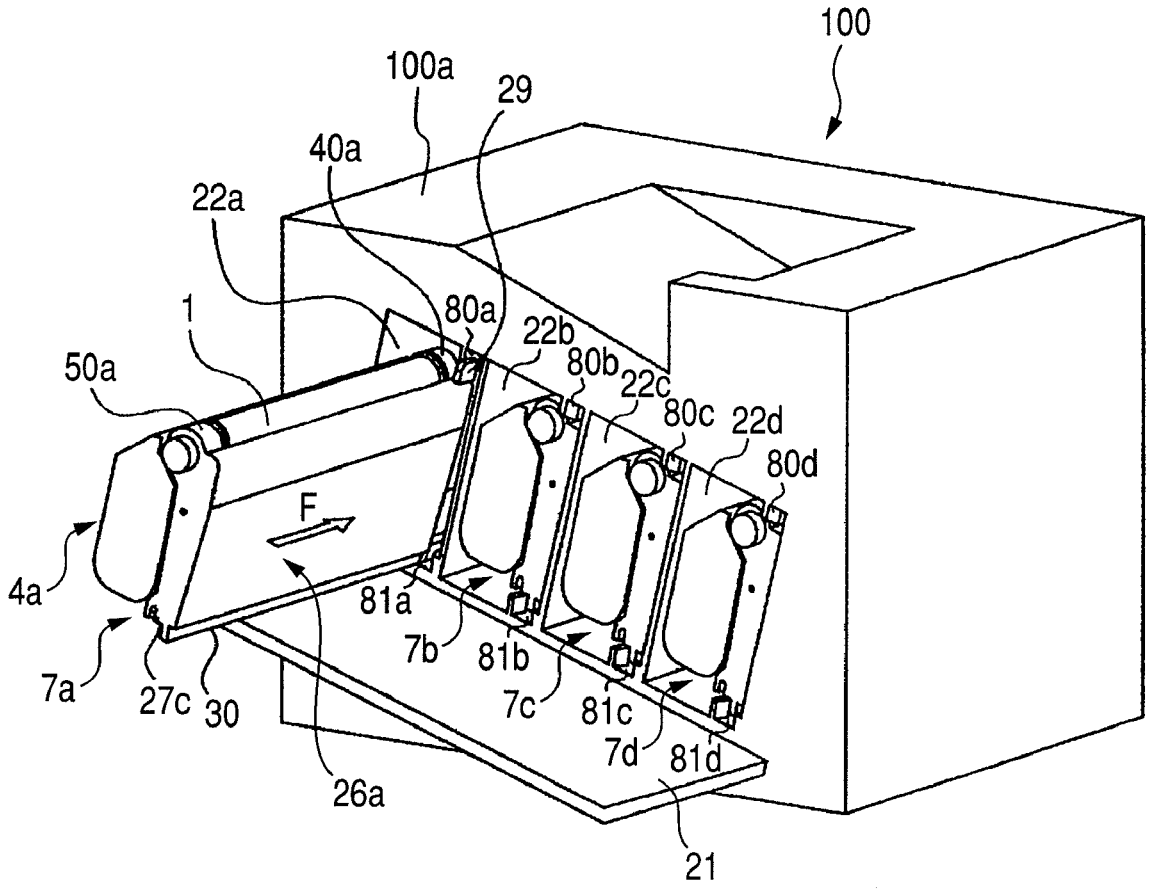
FIG. 4 is a perspective view illustrating the state of the cartridge prior to mounting to a main body of the image forming apparatus.

Next, with reference to FIG. 4, a description will be provided of a mounting construction in which the cartridge 7 according to this embodiment is detachably mountable to an inside of the main body of the image forming apparatus.

FIG. 4 is a perspective view illustrating the state prior to the mounting of a cartridge to the apparatus main body 100*a*. In this embodiment, the mounting of the cartridge 7 to the apparatus main body 100*a* is effected by inserting the cartridge 7 in a direction indicated by an arrow F, which is a direction parallel to the axial direction of the photosensitive drum 1, that is, from the front side to the rear side as seen in FIG. 2. In this way, the cartridge 7 is detachably mountable to the main body 100*a*.

In FIG. 4, a front cover 21 that can be opened and closed is provided on the front side of the main body 100*a*. When the front cover 21 is opened, there are exposed the mounting portions 22 (22*a* through 22*d*) of the four cartridges 7 (7*a* through 7*d*) arranged side by side so as to be inclined with respect to the horizontal direction. On the upper side and the lower side of the mounting portions 22, there are provided mounting upper guides 80 (80*a*, 80*b*, 80*c*, and 80*d*), which are first main body side guides extending from the front side to the rear side of the main body 100*a*, and mounting lower guides 81 (81*a*, 81*b*, 81*c*, and 81*d*), which are second main body side guides, respectively. Further, a guided portion (first cartridge side guided portion) 29 provided on the photosensitive unit 26 of the cartridge 7 is engaged with the mounting upper guide 80 of the main body 100*a*, and similarly, a guided portion (second cartridge side guide portion) 30 provided on the photosensitive unit 26 is engaged with the mounting lower guide 81 of the main body 100*a*, and the cartridge is pushed into the mounting portion in the direction indicated by the arrow F of FIG. 4.

The first guided portion 29 is arranged on the upper portion of the forward end side of the cartridge 7. The second guided portion 30 is arranged on the bottom surface of the cartridge 7 to extend from the forward end side to the rear end side of the cartridge 7.

The guided portion 29 and the guided portion 30 are arranged on the same side with respect to the photosensitive drum 1 in a direction perpendicular to the axis of the photosensitive drum 1. This enables the cartridge 7 to proceed into the main body 100*a in a stable manner.*

(Developing Roller Separating Construction of Process Cartridge)

Next, a separation mechanism for the photosensitive drum 1 and the developing roller 25 in the process cartridge 7 of the embodiment of the present invention will be described with reference to FIG. 5.

Figure 5:
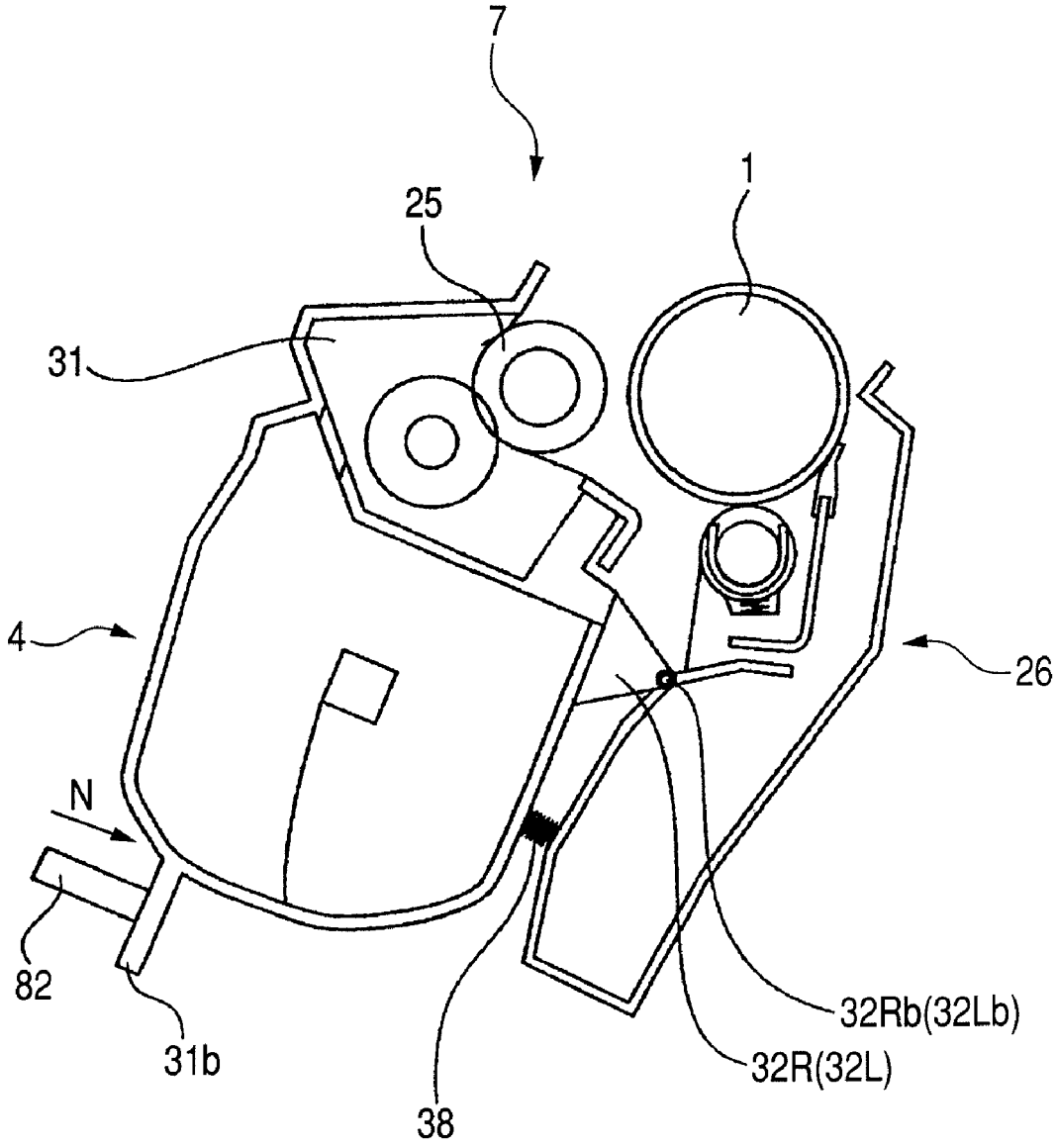
FIG. 5 is a sectional view illustrating a developing roller separating operation according to an embodiment of the present invention.
Figure 6:
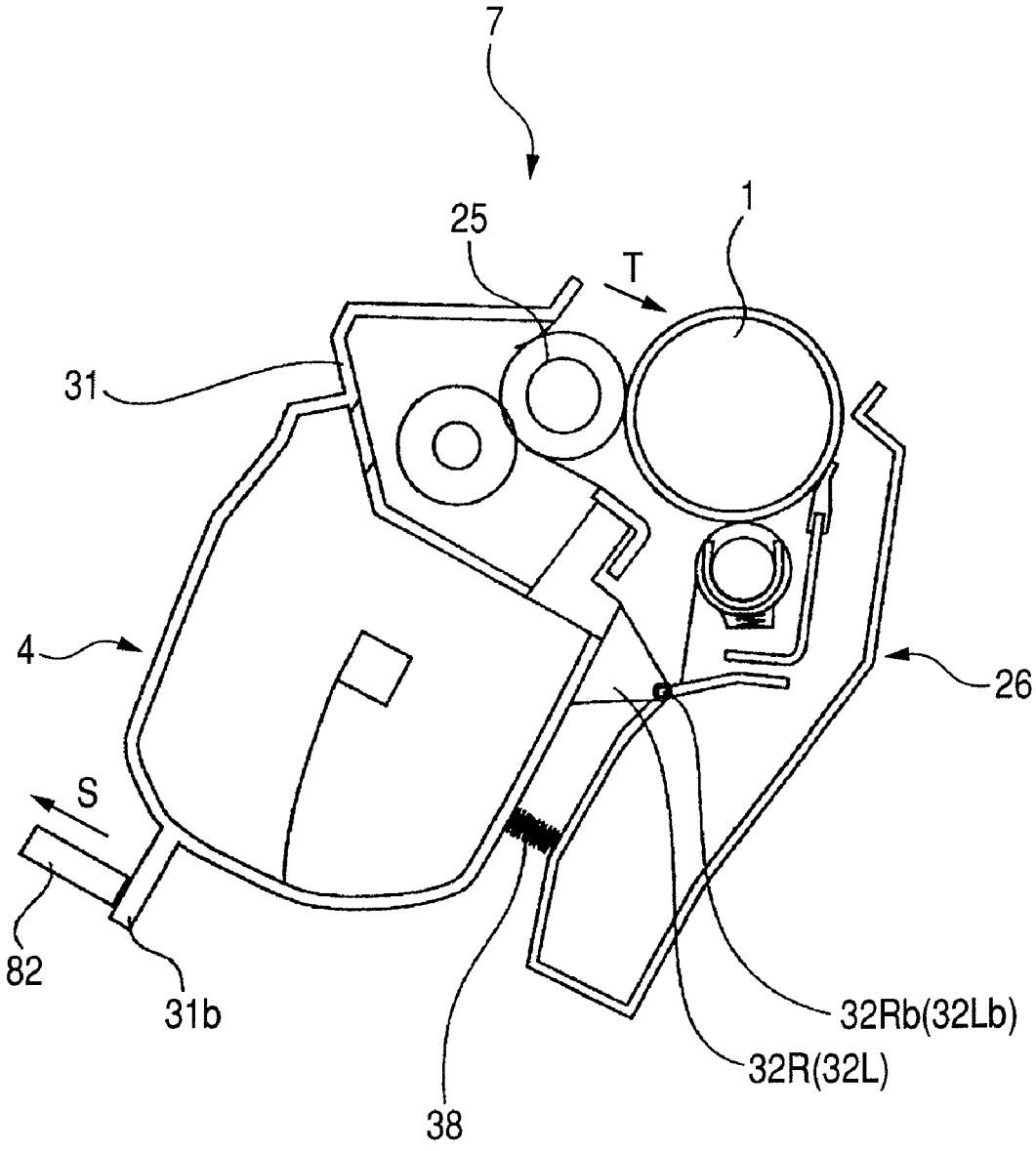
FIG. 6 is a sectional view illustrating a developing roller contacting operation according to an embodiment of the present invention.

In FIG. 5, the image forming apparatus 100 (not shown) is provided with a developing roller separating member 82 at a predetermined position in the longitudinal direction of the process cartridge 7. The developing roller separating member 82 is moved in a direction indicated by an arrow N by a main body drive (not shown). In the developing unit 4 of the process cartridge 7, a force receiving portion 31*b* of the developing frame 31 receives a force from the developing roller separating member 82 moving in the direction indicated by the arrow N. Further, the developing roller 25 is moved to a separated position where the developing roller 25 is separated from the photosensitive drum 1. As illustrated in FIG. 6, when the developing roller separating member 82 moves in a direction indicated by an arrow S to be separated from the force receiving portion 31*b*, the developing unit 4 is rotated about the holes 32Rb and 32Lb of a developing unit front bearing 32R and a developing unit rear bearing 32L in a direction indicated by an arrow T by the urging force of the compression spring 38 and an extension spring (not shown). Then, the developing unit 4 moves to a contact position, where the developing roller 25 and the photosensitive drum 1 are in contact with each other. With this developing roller separating construction, except at the time of image formation, the developing roller separating member 82 pushes the force receiving portion 31*b* and keeps it, whereby the developing unit 4 is held at the separated position illustrated in FIG. 5. This helps to obtain the effect of suppressing the influence of deformation of the developing roller 25 on the image quality.

Figure 7:
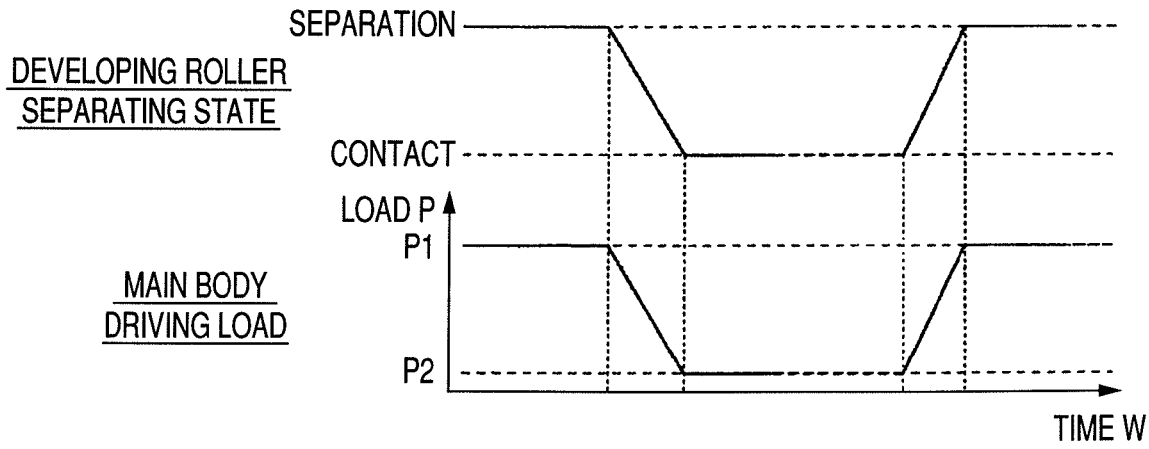
FIG. 7 is a driving load chart illustrating how a developing roller separating member of an image forming apparatus according to an embodiment of the present invention is operated.

Here, FIG. 7 is a main body driving load chart, illustrating how the developing roller 25 is held in and out of contact with the photosensitive drum 1 and how the developing roller separating member 82 is driven. In the state in which the developing roller 25 and the photosensitive drum 1 are separated from each other, the developing roller separating member 82 requires a driving load P1 for maintaining the state in which the force receiving portion 31*b* is pushed. In association with the start of the image forming operation, the developing roller separating member 82 moves in the direction indicated by the arrow S to bring the developing roller 25 into contact with the photosensitive drum 1, and the driving load for pushing the force receiving portion 31*b* is reduced. Further, when the developing roller separating member 82 and the force receiving portion 31*b* are separated from each other, the requisite driving load for the developing roller separating member 82 is P2.

Next, the separation construction for the charging roller 2 will be described.

(Separation Holding Member for Charging Roller)

Figure 8:
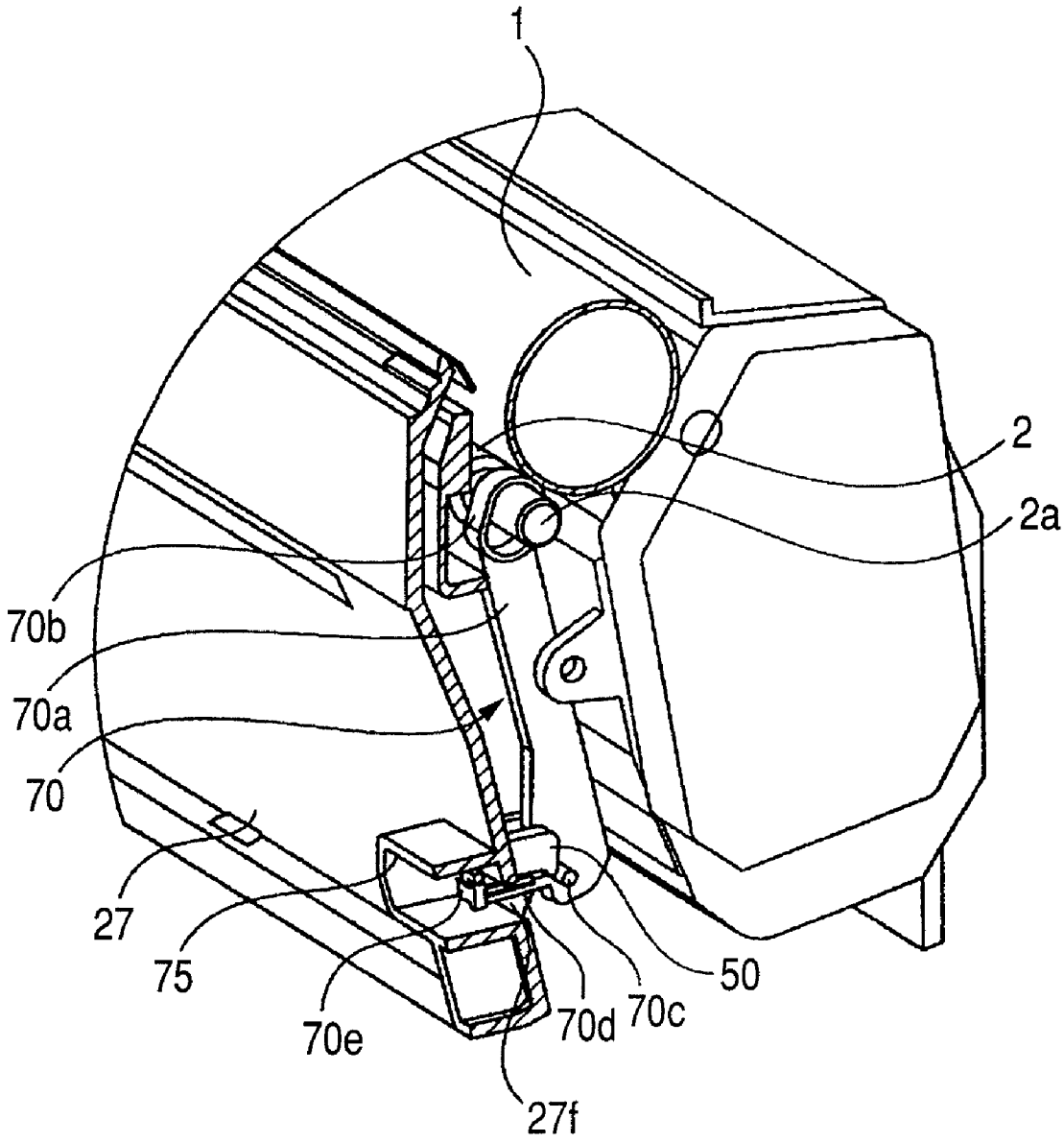
FIG. 8 is an inclined sectional view of a process cartridge according to an embodiment of the present invention.

First, a separation holding member 70 for effecting separation of the charging roller 2 will be described with reference to FIG. 8. FIG. 8 is an inclined sectional view of one end portion of the cartridge.

While in this embodiment one end portion on the downstream side in the main body mounting direction of the charging roller 2 will be described for the sake of convenience, it is also possible to provide the same constructions at both end portions of the charging roller 2.

As illustrated in FIG. 8, the separation holding member 70 has a shaft holding portion 70*b* at one end of a connecting portion 70*a*, and a locking portion 70*c* and a penetration portion 70*d* at the other end of the connecting portion 70*a*.

A cleaning frame 27 is provided with a hook portion 50 that is a holding portion engageable with the locking portion 70*c*, and an aperture portion 27*f* at the base of the hook portion 50.

The shaft holding portion 70*b* holds a core metal 2*a* of the charging roller 2.

The locking portion 70*c* is formed to be in the same convex shape on each of both surfaces of the other end of the separation holding member 70, and can be locked with the hook portion 50.

The penetration portion 70*d* protrudes toward the exterior of the frame from the aperture portion 27*f* of the cleaning frame 27, and has at its distal end a acted portion 70*e* that can be brought into contact with separation acting means (hereinafter referred to as acting means, which will be described in detail below) of the apparatus main body.

The separation holding member 70 can be moved between the first position in which the charging roller 2 is held in the state of being separated from the photosensitive drum 1 and the second position in which the charging roller 2 is brought into the contact state with the photosensitive drum 1.

The hook portion 50 holds the separation holding member 70 in the first position. The acting means of the apparatus main body releases the holding of the separation holding member 70 from the hook portion 50, and moves the separation holding member 70 to the second position. In other words, at the first position, the hook portion 50 and the locking portion 27*c* are locked with each other, and at the second position, the hook portion 50 and the locking portion 27*c* are not locked with each other.

(Separation Holding Construction for Charging Roller)

Figure 1:
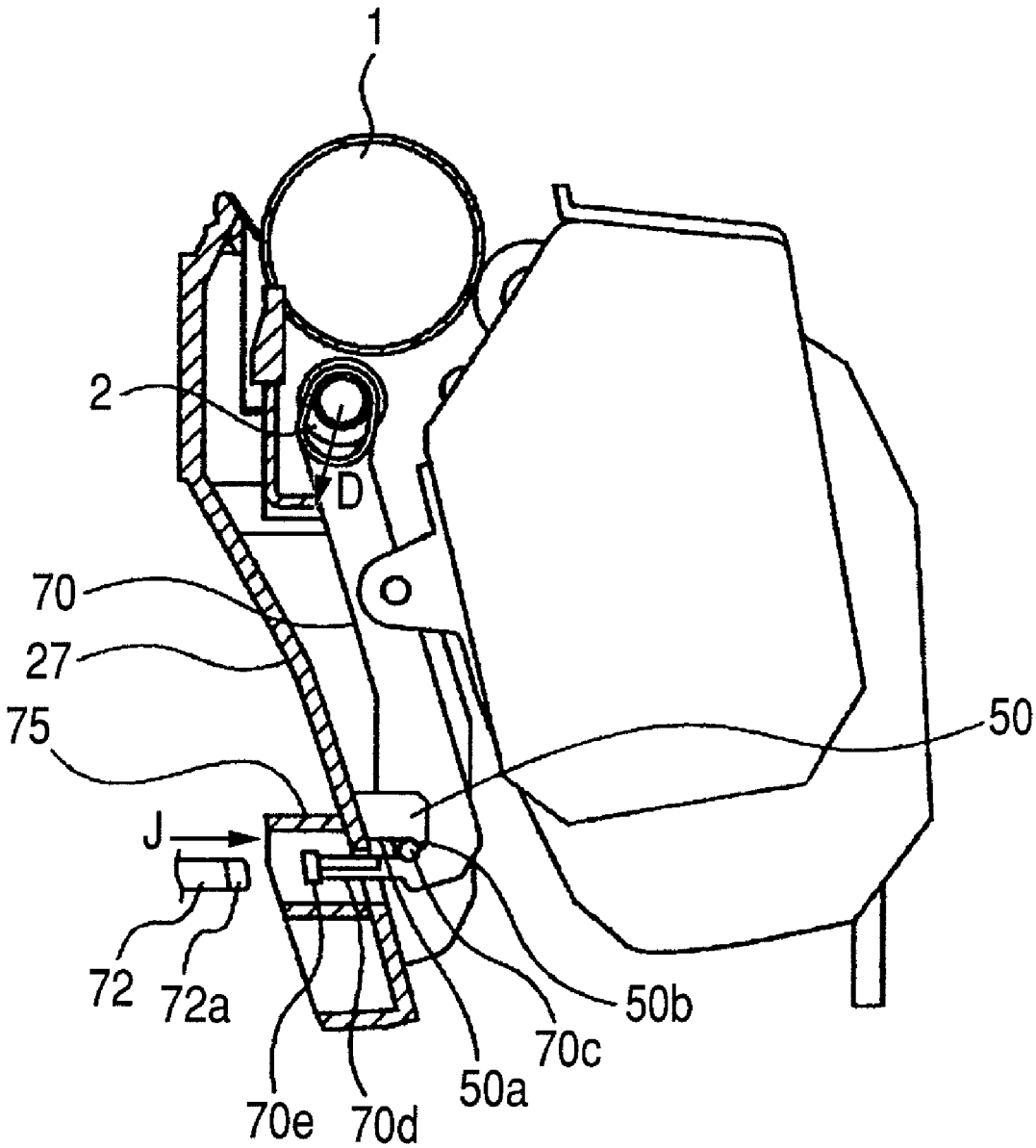
FIG. 1 is a sectional view of a cartridge according to an embodiment of the present invention.

Next, the separation holding construction for the charging roller 2 will be described with reference to FIGS. 1 and 9. FIG. 1 is a sectional view of the process cartridge in the state in which the charging roller 2 is separated from the photosensitive drum 1, and FIG. 9 is a partial perspective view of the separation holding member 70 and the hook portion 50.

Figure 9:
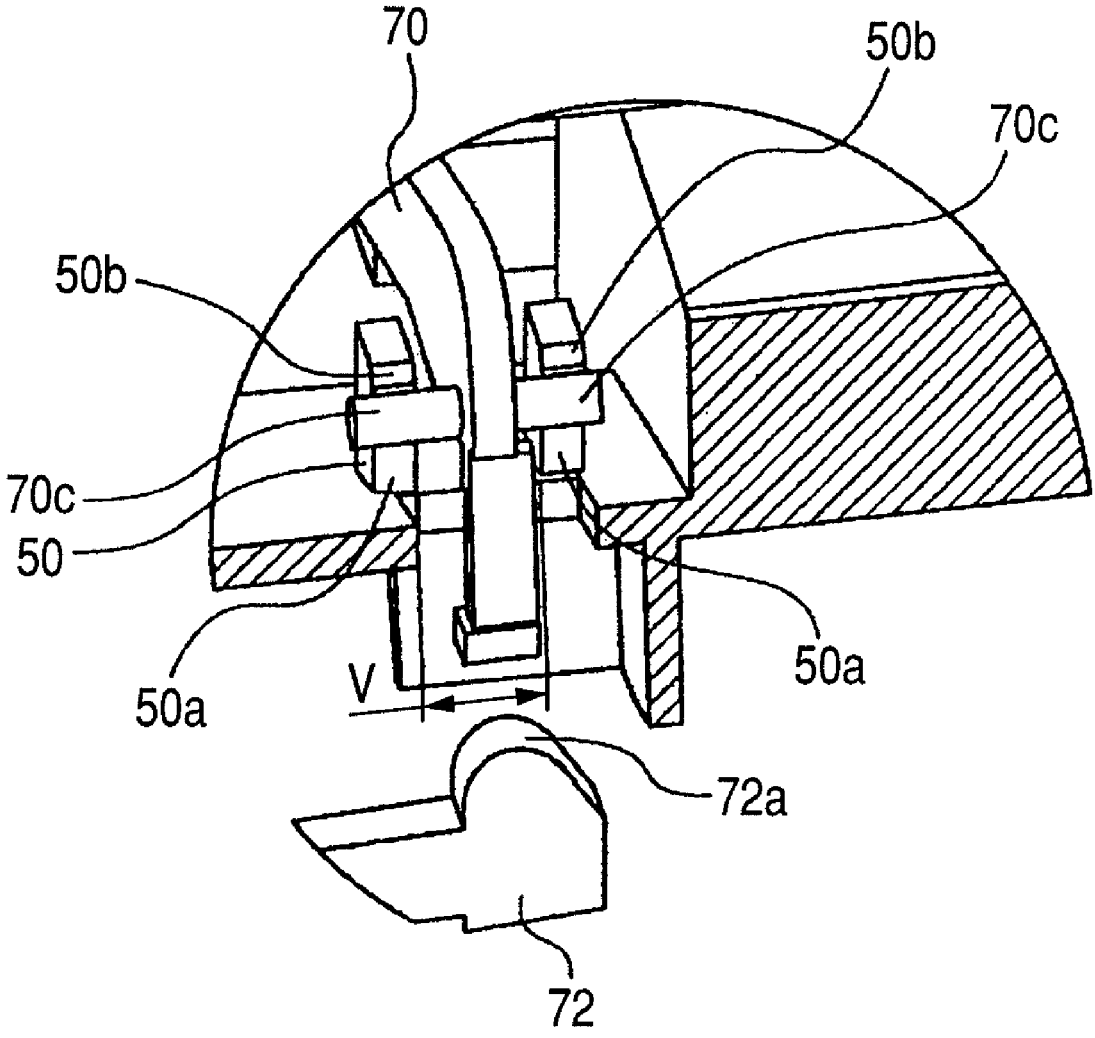
FIG. 9 is a partial sectional perspective view of the process cartridge, illustrating a charging roller separation holding member according to an embodiment of the present invention.

As illustrated in FIG. 9, the hook portion 50 includes a holding surface 50*a* and a claw portion 50*b*.

The holding surface 50*a* is a surface for holding the separation holding member 70. The claw portion 50*b* is formed into a convex shape in the hook portion 50 and hooks the locking portion 70*c* to hold the separation holding member 70.

The hook portion 50 is arranged at each of two points with a space V therebetween in the longitudinal direction of the process cartridge 7. The separation holding member 70 can move in the space V between two hook portions 50. The separation holding member 70 is pulled in the separation direction D (FIG. 1) to separate the charging roller 2 from the photosensitive drum 1. In this state, the locking portion 70*c* is hooked on the hook portion 50 to be locked therewith (in the first position), whereby the charging roller 2 is held in the separation state in which the charging roller 2 is separated from the photosensitive drum 1.

(Separation Releasing Construction for Charging Roller)

Figure 10A:
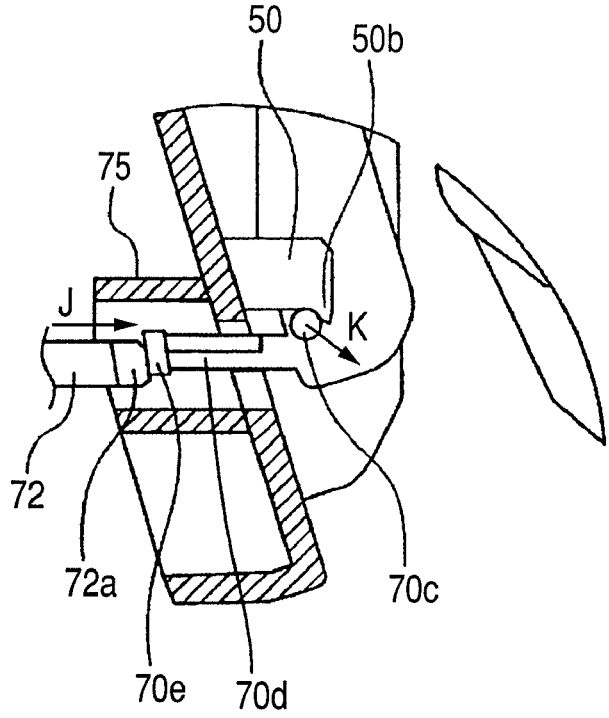
FIGS. 10A and 10B are partial sectional views of the process cartridge according to an embodiment of the present invention.
Figure 10B:
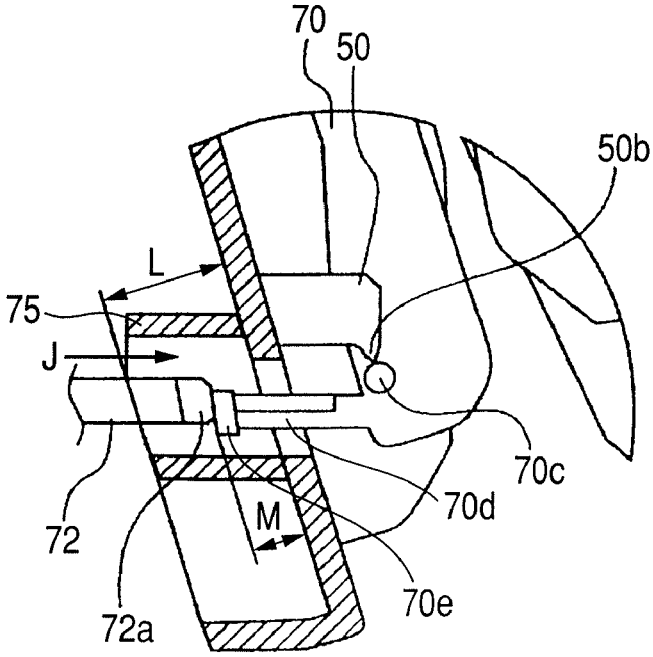

Next, the separation releasing construction for the charging roller 2 will be described with reference to FIGS. 1, 8, 9, 10A, and 10B. FIGS. 10A and 10B are partial sectional views of the rear end portion of the separation holding member 70.

As illustrated in FIG. 1, in the image forming apparatus, a separation lever 72, which is an acting means, is arranged at a predetermined position in the longitudinal direction of the process cartridge 7.

The separation lever 72 has at the distal end thereof an acting portion 72*a*, and can be moved in a direction indicated by an arrow J by a main body drive (not shown). In accordance with the moving of the separation lever 72, the acting portion 72*a* is brought into contact with the acted portion 70*e* of the separation holding member 70 provided so as to penetrate the aperture portion 27f of the cleaning frame 27 (FIG. 10A). The contacting acting portion 72*a* further moves in the direction indicated by the arrow J, whereby the acting portion 72*a* pushes the acted portion 70*e* of the separation holding member 70. As a result, the locking portion 70*c* of the separation holding member 70 moves in a direction indicated by an arrow K along the claw portion 50*b* provided on the hook portion 50. Further, when the locking portion 70*c* goes over the claw portion 50*b*, the locking of the hook portion 50 and the locking portion 70*c* is released (FIG. 10B). In the state in which the locking has been released, the separation holding member 70 and the charging roller 2 are moved in the contact direction by the urging force of a compression spring (not shown). Further, the charging roller 2 comes into contact with the photosensitive drum 1 with a predetermined pressure. At this time, the separation holding member 70 is at the second position (FIG. 8).

(Separation Lever Mechanism of Image Forming Apparatus)

Figure 11:
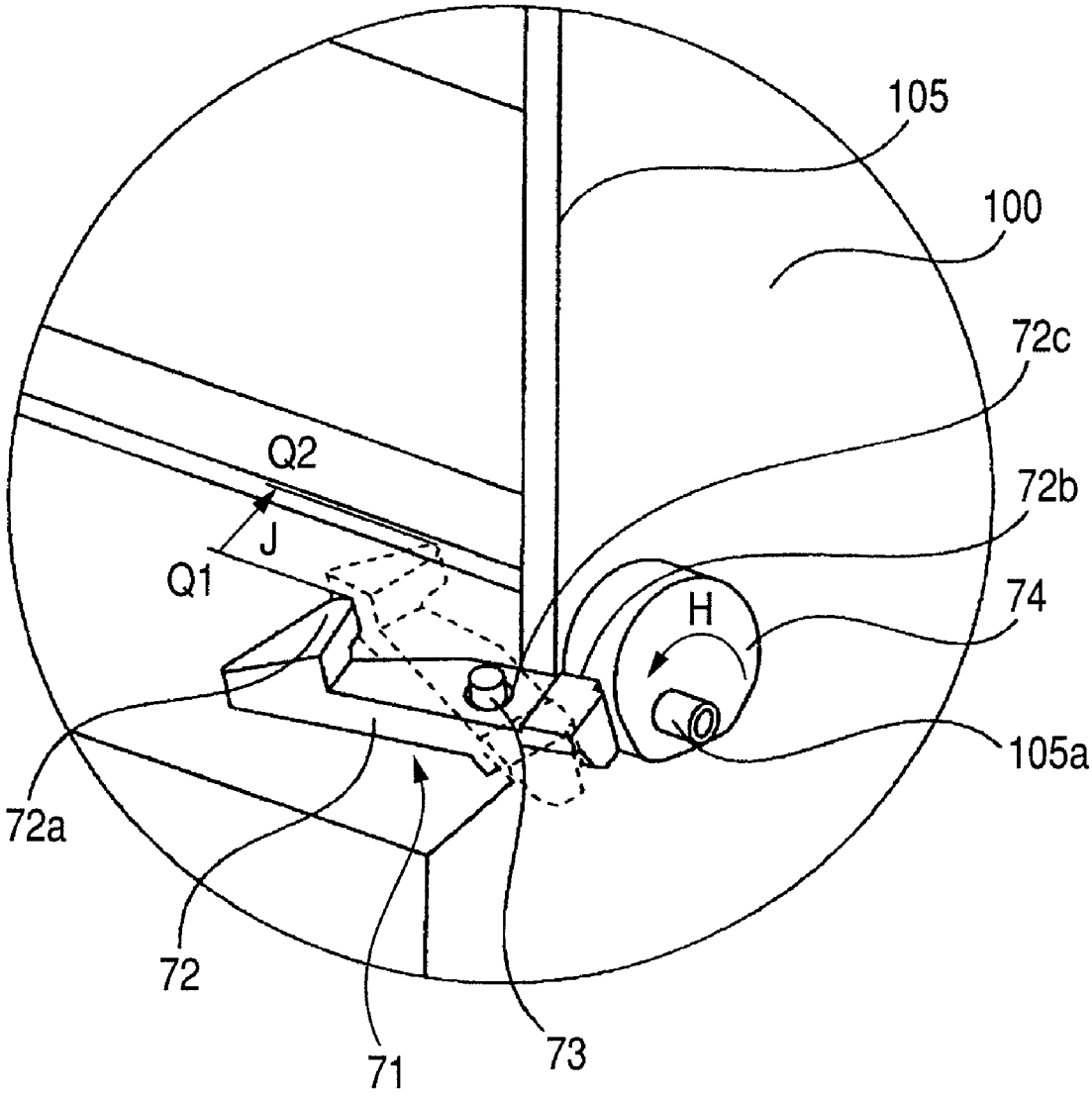
FIG. 11 is a partial sectional perspective view of a main body separation lever mechanism portion according to an embodiment of the present invention.

Here, the construction of a separation lever mechanism 71, which is an acting means of the main body described above, will be described in detail with reference to FIGS. 5, 10A, 10B, and 11. FIG. 11 is a partial perspective view of the separation lever mechanism 71 arranged on the apparatus rear side, which is the downstream side in the cartridge mounting direction of the image forming apparatus 100.

As illustrated in FIG. 11, on the rear side of the main body of the image forming apparatus 100, there is provided the separation lever mechanism 71, which is a separation releasing means including the separation lever 72, a shaft 73, and a driving cam 74. The driving cam 74 is rotatably supported by a cam shaft 105*a* provided on a rear-side side plate 105. The driving cam 74 can be rotated in a direction indicated by an arrow H of FIG. 11 by the same main body drive (not shown) as that for the developing roller separating member 82 (see FIG. 5) for effecting the contact and separation of the developing roller 25.

The separation lever 72 includes the acting portion 72*a*, a drive acting portion 72*b*, and a rotation shaft portion 72*c*. As illustrated in FIGS. 10A and 10B, the acting portion 72*a* can be brought into contact with the acted portion 70*e* of the separation holding member 70. The driving cam 74 is rotated in the direction indicated by the arrow H by the main body drive, and comes into contact with the drive acting portion 72*b* of the separation lever 72. Further, the separation lever 72 is rotated about the shaft 73 in the direction indicated by the arrow J by the driving cam 74 in contact with the drive acting portion 72*b*. At the time of mounting the cartridge, the separation lever 72 is arranged at an initial position Q1 where the separation lever 72 does not interfere with the separation holding member 70 situated at the first position while holding the charging roller 2 in the separated state. Further, at the time of image formation, the separation lever 72 is rotated in the direction indicated by the arrow J to a releasing position Q2 by the main body drive. Through the rotation of the separation lever 72 from the position Q1 to the position Q2, the acting portion 72*a* pushes the acted portion 70*e* of the separation holding member 70, and releases the locking of the hook portion 50 and the locking portion 70*c*. The separation holding member 70 released from the locking moves to the second position. At this time, the charging roller 2 is held in contact with the photosensitive drum 1.

Figure 12:
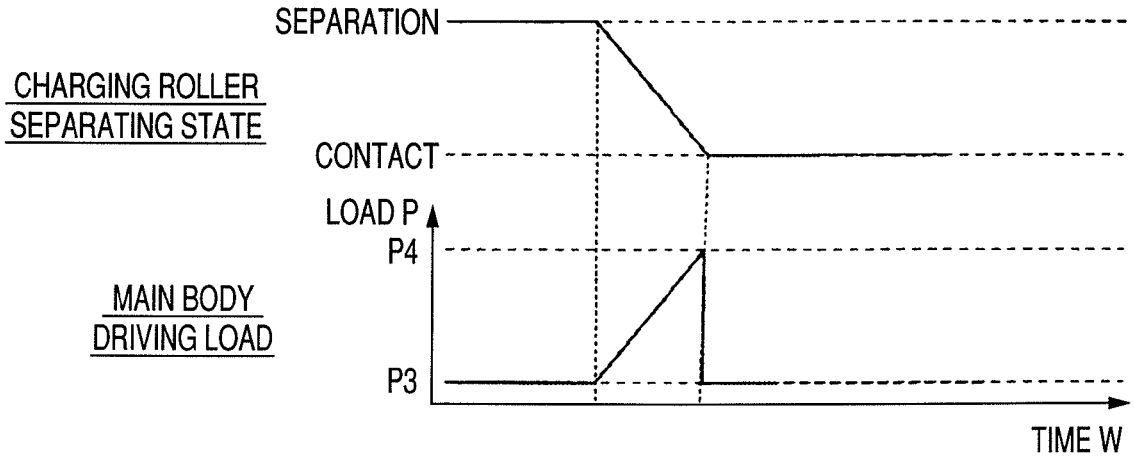
FIG. 12 is a driving load chart illustrating how a separation lever in the image forming apparatus according to an embodiment of the present invention is operated.

Here, FIG. 12 is a chart illustrating the contact and separation states of the charging roller 2 and the main body driving load. In the state in which the charging roller 2 and the photosensitive drum 1 are separated from each other, the separation lever 72 is at the initial position, and hence the separation lever 72 is not in contact with the separation holding member 70. At this time, the driving load is P3. Further, when the separation lever 72 is rotated in the direction indicated by the arrow J by the main body drive, and starts to act on the acted portion 70*e* of the separation holding member 70, the locking of the locking portion 70*c* and the hook portion 27e is released, and hence the requisite driving force increases. Further, when the locking portion 70*c* goes over the claw portion 50*b* of the hook portion 50, a driving load of P4 is required.

Figure 13:
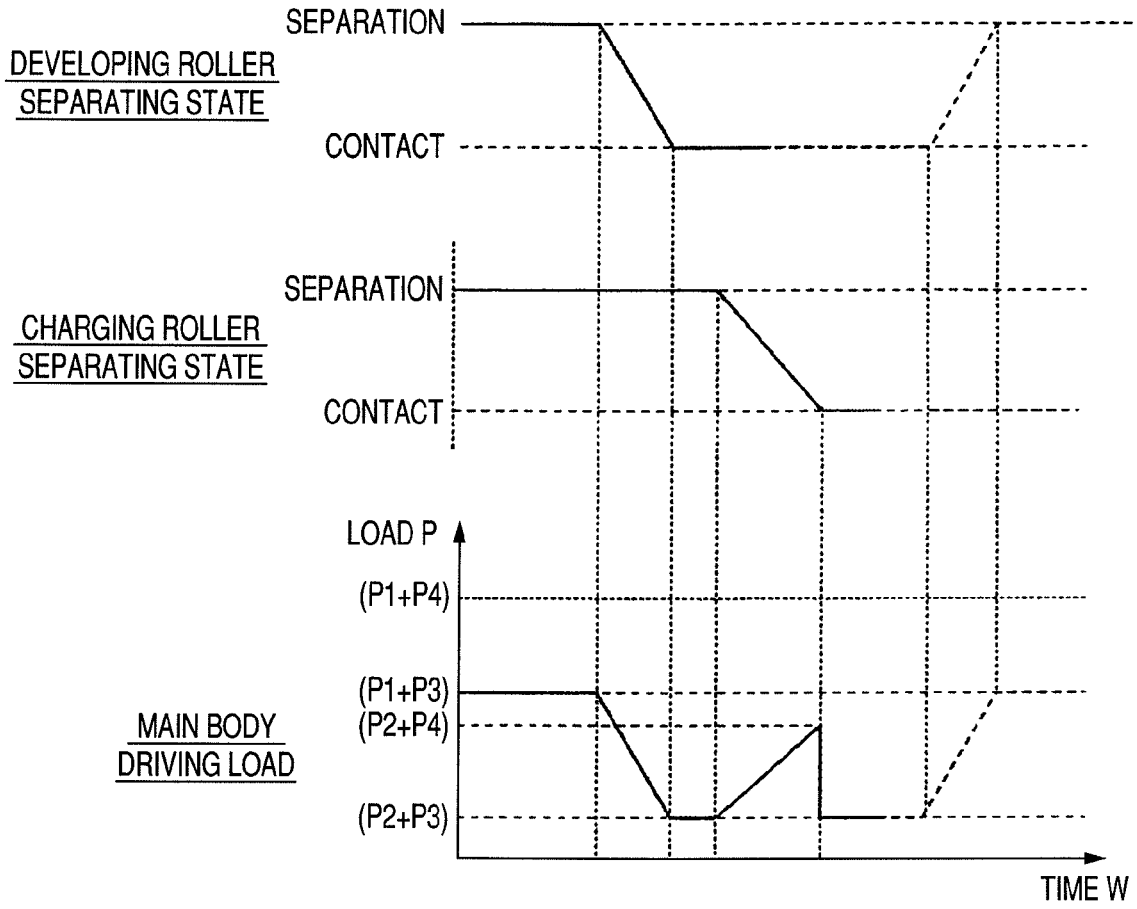
FIG. 13 is a driving load sequence chart according to an embodiment of the present invention.

A driving sequence for the developing roller separating member 82 for effecting the contact and separation of the developing roller 25 and the separation lever 72 for releasing the separation of the charging roller 2 of this embodiment will be described with reference to FIG. 13. As described above, the developing roller separating member 82 and the separation lever 72 are operated by the same main body drive. As illustrated in FIG. 13, in the process cartridge 7 mounted in the main body of the image forming apparatus, both the developing roller 25 and the charging roller 2 are separated from the photosensitive drum 1. At the time of use, the drive is first acted upon the developing roller separating member 82 to bring the developing roller 25 from the separation state to the contact state. After this, the drive is acted upon the separation lever 72 to bring the charging roller 2 into the contact state. In this way, the developing roller 25 is brought into the contact state, and then the separation of the charging roller 2 is released, whereby it is possible to disperse the load P1 for holding the separation of the developing roller 25 and the load P4 for releasing the separation of the charging roller 2. That is, it is possible to achieve a reduction in the main body driving load.

(Construction of Protruding Portion)

Figure 14:
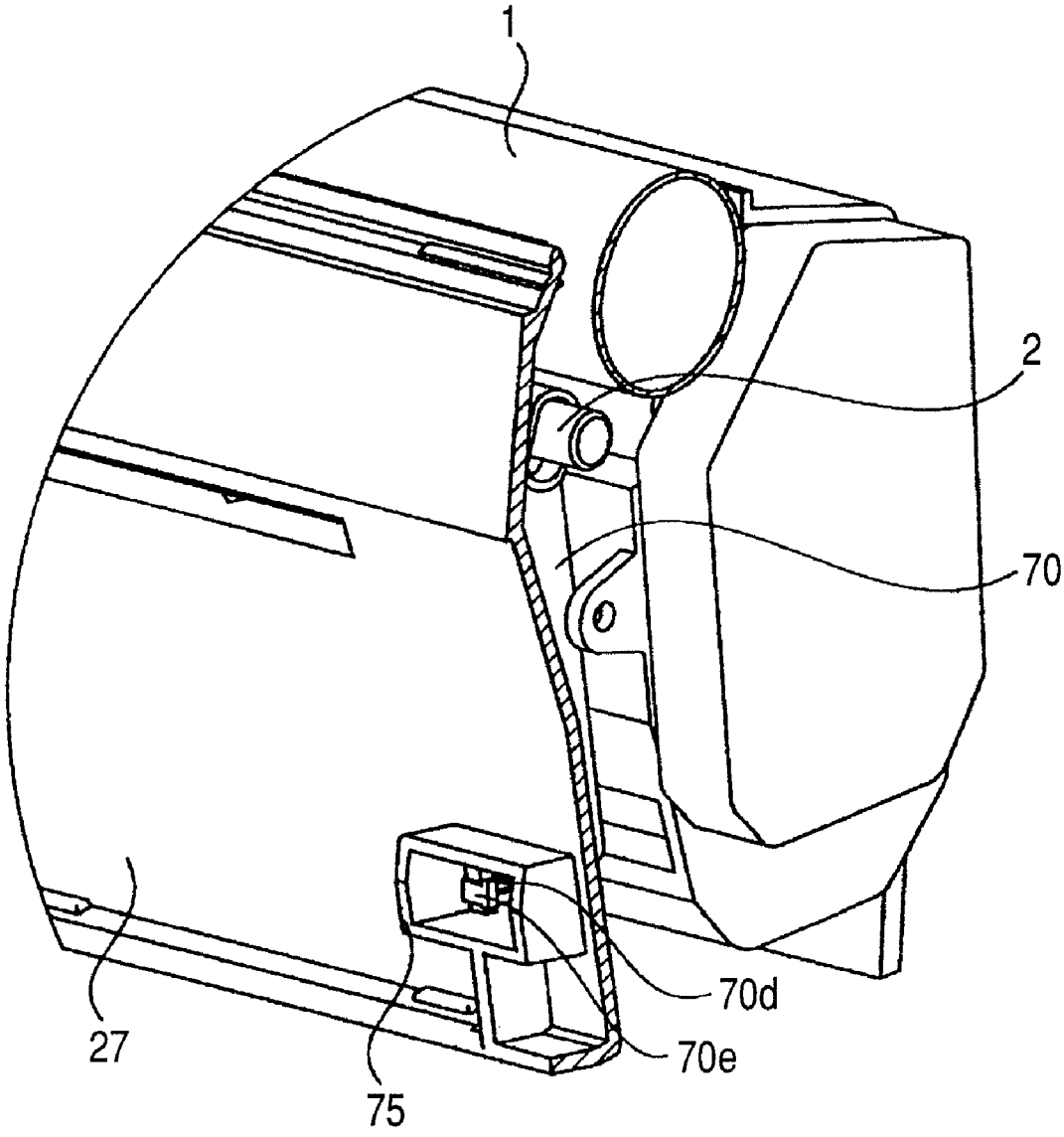
FIG. 14 is a sectional perspective view of the process cartridge according to an embodiment of the present invention.

Next, the construction of a protruding portion 75, which is a feature of this embodiment, will be described with reference to FIGS. 10A, 10B, and 14. FIG. 14 is a partial perspective view of the process cartridge.

As described above, when the charging roller 2 is in the state of being separated from the photosensitive drum 1, that is, when the separation holding member 70 is at the first position, the penetration portion 70*d* protrudes to the exterior of the cleaning frame 27. On the cleaning frame 27, there is provided the rib-like protruding portion 75 surrounding the penetration portion 70*d* of the separation holding member 70 as illustrated in FIGS. 10A, 10B, and 14. The protruding portion 75 is provided so as to be high enough not to allow the acted portion 70*e* at the distal end of the penetration portion 70*d* to poke out. By thus providing the protruding portion 75 so as to make it high enough not to allow the acted portion 70*e* to poke out, it is possible to prevent the user from inadvertently pushing the acted portion 70*e*. Thus, it is possible to prevent releasing of the locking of the locking portion 70*c* of the separation holding member 70 and the hook portion 50 of the cleaning frame 27, and it is possible to prevent the charging roller 2 and the photosensitive drum 1 from being brought into contact with each other.

Here, it is necessary for the protruding height L of the protruding portion 75 for preventing erroneous releasing by the user to be at least larger than a poke-out amount M by which the locking portion 70*c* of the separation holding member 70 pokes out of the frame of the acted portion 70*e* when the locking portion 70*c* gets over the claw portion 50*b* provided on the hook portion 50.

In the construction described above, the charging roller 2 can be maintained at a predetermined distance from the photosensitive drum 1 prior to use, and at the time of use, it is possible to release the separation state of the charging roller 2 without increasing the burden on the user. Further, prior to use, it is possible to prevent erroneous releasing of the separation state of the charging roller 2 by the user.

(Second Embodiment)

Next, a process cartridge and an image forming apparatus according to a second embodiment of the present invention will be described with reference to FIGS. 15, 16A, and 16B.

Figure 15:
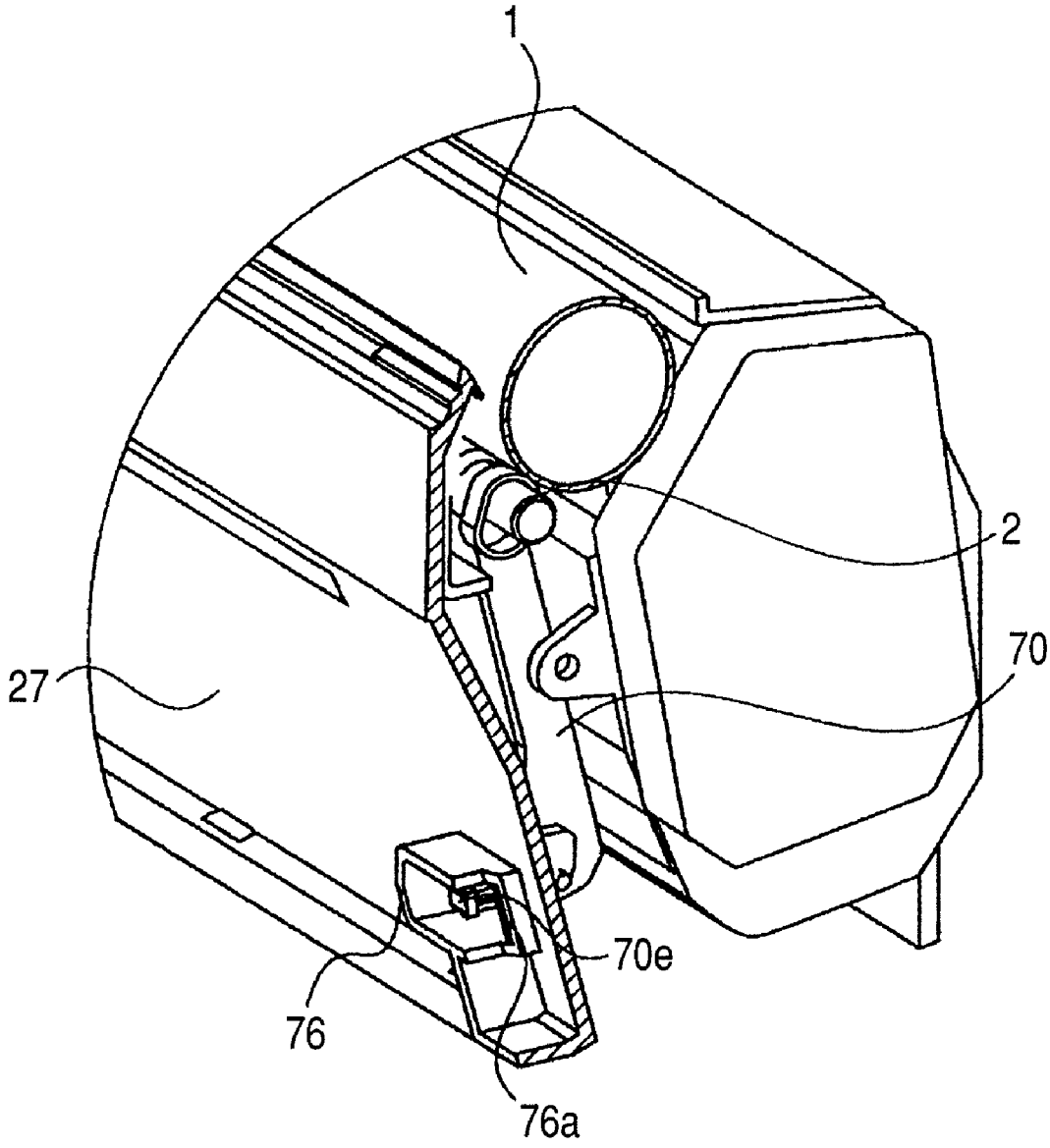
FIG. 15 is a sectional perspective view of the process cartridge according to an embodiment of the present invention.
Figure 16A:
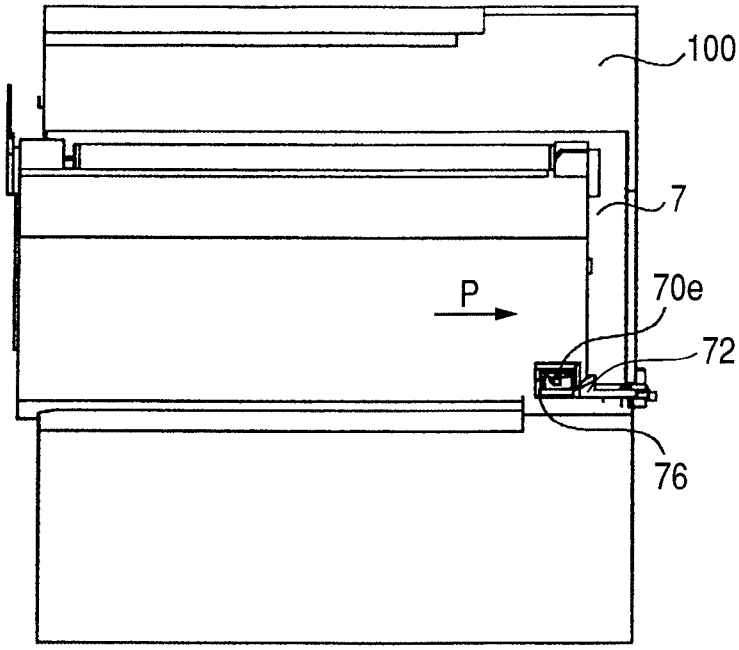
FIGS. 16A and 16B are partial sectional perspective views of the image forming apparatus and the process cartridge according to an embodiment of the present invention.
Figure 16B:
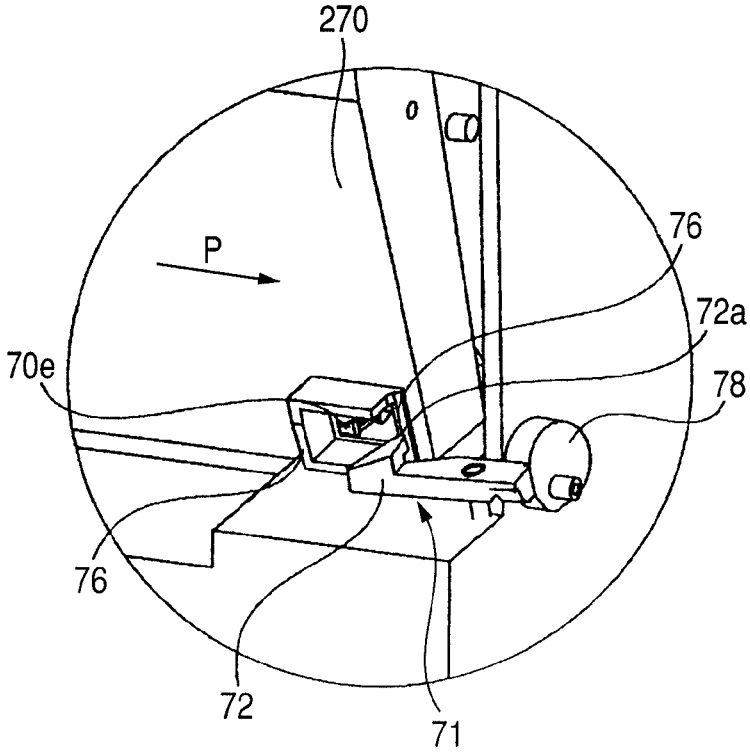

FIG. 15 is a schematic perspective view of a protruding portion according to this embodiment, FIG. 16A is a sectional view of the cartridge of this embodiment as mounted to the main body, and FIG. 16B is a schematic perspective view of the separation lever portion at the time of mounting the cartridge to the main body. The portions that are the same as those of the first embodiment described above are denoted by the same reference symbols, and a description thereof is omitted.

As illustrated in FIG. 15, a cleaning frame 270 is provided with a protruding portion 76 having an opening portion 76*a* on the rear side in the mounting direction.

As described above, at the time of mounting the cartridge, the separation lever 72 holds the charging roller 2 in the separation state of the charging roller 2, and is arranged at a retracted, initial position so that the separation lever 72 may not interfere with the separation holding member 70 at the first position. Here, by providing the protruding portion 76 with the opening portion 76*a*, it is possible to mount the cartridge without interference with the protruding portion 76 even if the retracting amount of the separation lever 72 at the initial position at the time of mounting is small. That is, it is possible to reduce the moving amount of the separation lever 72, and hence it is possible to achieve an improvement in terms of the degree of freedom in design of the driving cam 78 and to reduce the size of the image forming apparatus 100.

According to the present invention, it is possible to maintain the charging roller at a predetermined distance from the photosensitive drum prior to use, and at the time of use, it is possible to release the separation state of the charging roller without increasing the burden on the user.

Further, it is possible to prevent erroneous releasing of the separation state of the charging roller by the user prior to the mounting of the process cartridge to the main body of the image forming apparatus.

Further, when the process cartridge is packaged with the main body of the image forming apparatus at the time of shipment, the releasing of the charging roller is not effected, and its releasing is effected at the time of use. As a result, it is possible to maintain the separation of the charging roller until the time of use without any operation on the side of the user, and hence it is possible to obtain a satisfactory image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138039, filed May 27, 2008, which is hereby incorporated by reference herein in its entirety.

What is claimed is:

1. A process cartridge detachably mountable to an image forming apparatus including an acting portion, the process cartridge comprising:

a photosensitive drum;

a charging roller that is urged in a direction in which the charging roller is brought into contact with the photosensitive drum to charge the photosensitive drum;

a frame supporting the photosensitive drum and the charging roller; and a separation holding member that is movably provided on the frame and engaged with the charging roller, the separation holding member having (a) a locking portion that is locked to the frame to separate the charging roller from the photosensitive drum, and (b) an acted portion that is acted by the acting portion, when the process cartridge is mounted to an apparatus main body of the image forming apparatus, for releasing a lock of the frame and the locking portion to bring the charging roller into contact with the photosensitive drum, wherein the separation holding member comprises a penetration portion that penetrates an aperture provided in the frame, pokes out of the frame, and has, at a distal end thereof, the acted portion, and wherein the frame has a protruding portion provided in a periphery of the penetration portion so as to protrude from the frame.

2. A process cartridge according to claim 1, wherein the protruding portion is provided on the frame so as to surround the penetration portion.

3. A process cartridge according to claim 1, wherein the protruding portion has a height large enough not to allow the acted portion to poke out beyond a distal end of the protruding portion.

4. A process cartridge according to claim 1, wherein the protruding portion has an opening portion which opens the acted portion on a downstream side in a mounting direction of the process cartridge to the apparatus main body.

5. A process cartridge according to claim 1, wherein the process cartridge is detachably mountable to the apparatus main body in an axial direction of the photosensitive drum.

6. A process cartridge according to claim 1, wherein the separation holding member is engaged at least with one end portion in an axial direction of the charging roller.

7. An image forming apparatus for forming an image on a recording medium, the image forming apparatus comprising:

(i) an acting portion;

(ii) a process cartridge detachably mounted to an apparatus main body of the image forming apparatus, the process cartridge comprising:

a photosensitive drum;

a charging roller that is urged in a direction in which he charging roller is brought into contact with the photosensitive drum to charge the photosensitive drum;

a frame supporting the photosensitive drum and the charging roller; and a separation holding member that is movably provided on the frame and engaged with the charging roller, the separation holding member having (a) a locking portion that is locked to the frame to separate the charging roller from the photosensitive drum, and (b) an acted portion which is acted by the acting portion, when the process cartridge is mounted to the apparatus main body of the image forming apparatus, for releasing a lock of the frame and the locking portion to bring the charging roller into contact with the photosensitive drum; and (iii) conveying means for conveying the recording medium, wherein the acting portion is moved by a driving force from the image forming apparatus and is brought into contact with the acted portion to release the lock of the frame and the locking portion.

* * * * *